US011339020B2

(12) United States Patent
Uchida

(10) Patent No.: US 11,339,020 B2
(45) Date of Patent: May 24, 2022

(54) PAPER STACKING APPARATUS, CONTROL METHOD, AND RECORDING MEDIUM

(71) Applicant: Eri Uchida, Kanagawa (JP)

(72) Inventor: Eri Uchida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 25 days.

(21) Appl. No.: 16/819,211

(22) Filed: Mar. 16, 2020

(65) Prior Publication Data

US 2020/0299090 A1 Sep. 24, 2020

(30) Foreign Application Priority Data

Mar. 19, 2019 (JP) ..... JP2019-051907

(51) Int. Cl.

| | |
|---|---|
| ***B65H 7/20*** | (2006.01) |
| ***B65H 43/00*** | (2006.01) |
| ***B65H 1/14*** | (2006.01) |
| ***B65H 1/18*** | (2006.01) |

(52) U.S. Cl.

CPC ..... *B65H 7/20* (2013.01); *B65H 1/14* (2013.01); *B65H 1/18* (2013.01); *B65H 43/00* (2013.01)

(58) Field of Classification Search

CPC ... B65H 7/20; B65H 1/14; B65H 1/18; B65H 43/00

See application file for complete search history.

(56) References Cited

U.S. PATENT DOCUMENTS

| | | | | |
|---|---|---|---|---|
| 4,861,016 | A * | 8/1989 | Ohyoshi | B65H 43/00 271/215 |
| 2009/0185812 | A1* | 7/2009 | Kayama | B65H 31/02 399/12 |
| 2019/0031461 | A1* | 1/2019 | Uchibori | G03G 21/1604 |
| 2019/0283998 | A1 | 9/2019 | Uchida et al. | |

FOREIGN PATENT DOCUMENTS

| | | |
|---|---|---|
| JP | H08-133495 | 5/1996 |
| JP | 2005-212966 | 8/2005 |
| JP | 2006-008404 | 1/2006 |
| JP | 2011-126646 | 6/2011 |

* cited by examiner

*Primary Examiner* — Thomas A Morrison
(74) *Attorney, Agent, or Firm* — Xsensus LLP

(57) ABSTRACT

A paper stacking apparatus according to an embodiment of the present disclosure includes a stacking table, a first sensor, and a hardware processor. The stacking table includes an upper face on which papers are stacked, the stacking table being capable of being elevated and lowered by a drive mechanism. The first sensor is disposed at a first position and configured to detect the upper face of the stacking table or an upper face of stacked objects stacked on the stacking table. The hardware processor is coupled to the drive mechanism and the first sensor. The hardware processor is configured to determine that the stacking table is excessively elevated when an elapsed time after starting to detect the object by the first sensor is at least a first excessive-elevation determination value of time.

14 Claims, 10 Drawing Sheets

PAPER STACKING APPARATUS, CONTROL METHOD, AND RECORDING MEDIUM

CROSS-REFERENCE TO RELATED APPLICATIONS

The present application claims priority under 35 U.S.C. § 119 to Japanese Patent Application No. 2019-051907, filed on Mar. 19, 2019. The contents of which are incorporated herein by reference in their entirety.

BACKGROUND OF THE INVENTION

1. Field of the Invention

The present invention relates to a paper stacking apparatus, a control method, and a recording medium.

2. Description of the Related Art

An image forming system includes a paper feeding device that carries out paper feeding to an image forming apparatus by taking out papers one by one from a tray having a plurality of papers stacked thereon. Techniques to prevent excessive stacking on a tray having papers stacked thereon have been proposed as conventional paper feeding devices.

For example, Japanese Patent Application Publication No. 2006-008404 discloses a paper feeding device that includes a first sensor and a second sensor. The first sensor is provided at a paper feeding position corresponding to a height at which papers are fed and detects a paper that has reached the paper feeding position. The second sensor is provided slightly above a paper feeding position detecting unit and detects excessive stacking of papers.

However, when the conventional paper feeding device is applied to a paper stacking apparatus on which papers discharged after printing is performed thereon in the main body of an image forming apparatus are stacked, a paper that falls down from above is detected by the second sensor, resulting in an erroneous determination that there is excessive stacking.

SUMMARY OF THE INVENTION

A paper stacking apparatus according to one aspect of the present invention includes: a stacking table including an upper face on which papers are stacked, the stacking table being capable of being elevated and lowered by a drive mechanism; a first sensor disposed at a first position and configured to detect the upper face of the stacking table or an upper face of stacked objects stacked on the stacking table; and a hardware processor coupled to the drive mechanism and the first sensor, the hardware processor being configured to determine that the stacking table is excessively elevated when an elapsed time after starting to detect the object by the first sensor is at least a first excessive-elevation determination value of time.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
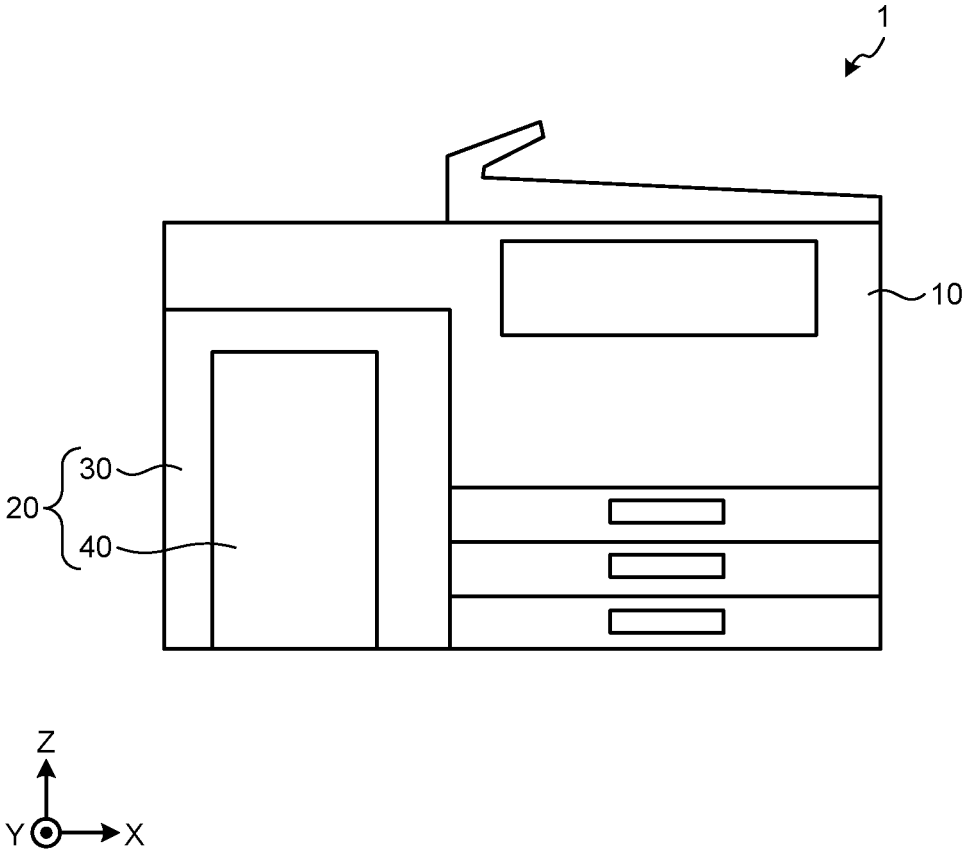
FIG. 1 illustrates an example of an image forming system.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

The present invention is directed to providing a paper stacking apparatus, a control method, and a recording medium that make it possible to avoid erroneously determining that there is excessive stacking when a paper falling from above is detected.

The following describes embodiments of a paper stacking apparatus, a control method, and a recording medium according to the present invention in detail with reference to the drawings. The following embodiments are not intended to limit the present invention, and constituent elements of the following embodiments include those easily conceivable by the skilled person, those substantially identical to each other, and those falling within so-called the range of equivalents. Various omissions, substitutions, and changes can be made to the constituent elements without departing from the spirits of the following embodiments.

First Embodiment

FIG. 1 illustrates an example of an image forming system. The image forming system 1 includes an image forming apparatus 10 and a paper receiving apparatus 20. The image forming apparatus 10 is specifically one from a broad range of well-known apparatuses including a copier, a facsimile, a printer, a plotter, a multifunction peripheral, and a printing press and functions as a paper supply source that forms images on standard-size papers and outputs the papers having the images formed thereon.

The paper receiving apparatus 20 is an apparatus that receives papers output from the image forming apparatus 10. The paper receiving apparatus 20 includes a housing 30 and a paper stacking apparatus 40 that can be drawn out from the housing 30 to the outside and can be contained into the housing 30. In the following description, the direction in which the paper stacking apparatus 40 is drawn out after being contained in the housing 30 is assumed as a Y direction, the direction perpendicular to the Y direction within a horizontal plane is assumed as an X direction, and the direction perpendicular to both the X direction and to the Y direction, that is, the height direction, is assumed as a Z direction.

Figure 2:
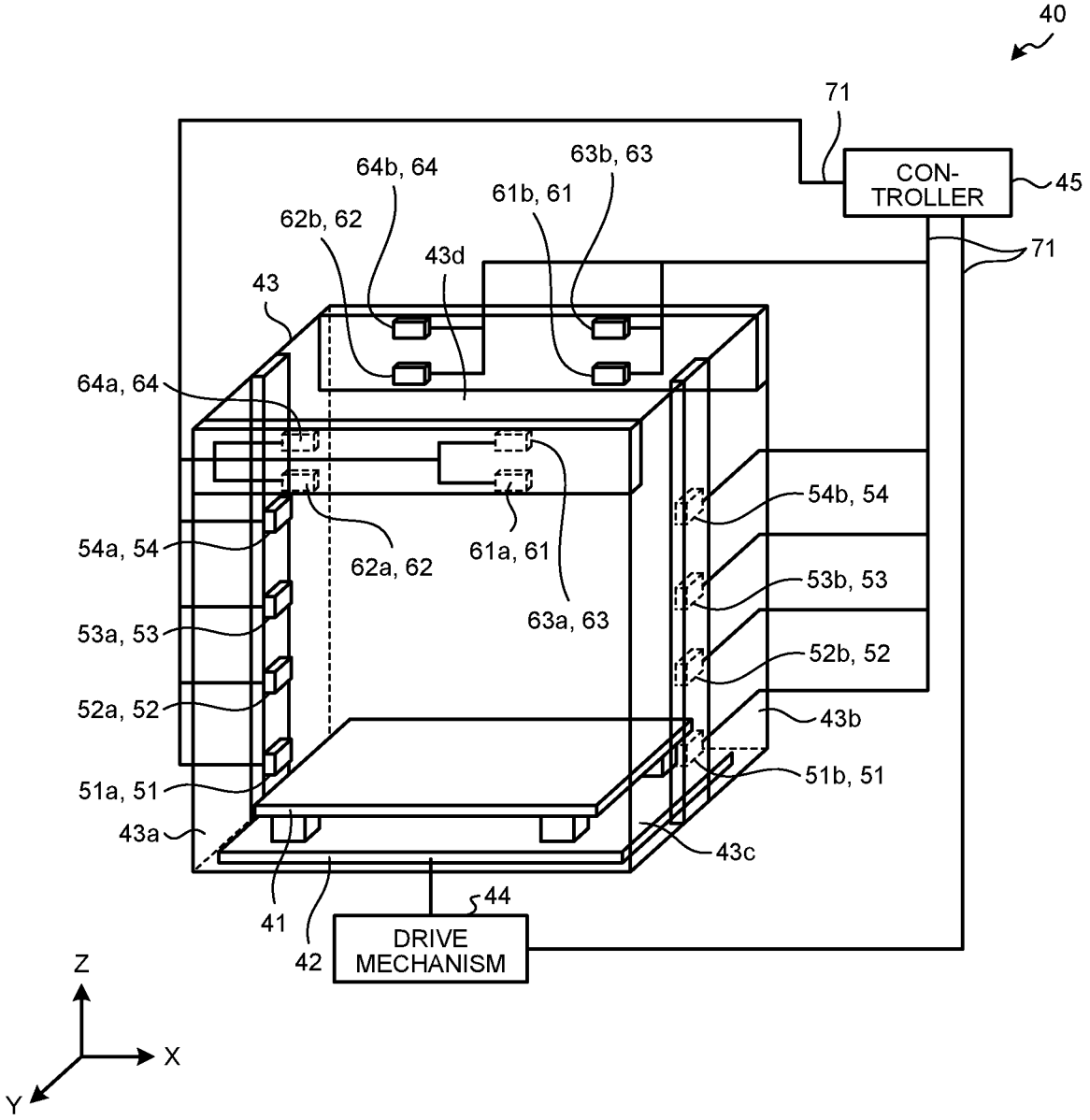
FIG. 2 illustrates an example of the configuration of a paper stacking apparatus according to a first embodiment.

FIG. 2 illustrates an example of the configuration of the paper stacking apparatus according to the first embodiment. The paper stacking apparatus 40 includes a pallet 41, an up-and-down table 42, a side wall part 43, and a controller 45. The pallet 41 serves as a table to receive papers on which printing has been performed. The up-and-down table 42 supports the pallet 41 and is movable in the Z direction. The side wall part 43 is provided to surround the outer peripheries of the pallet 41 and the up-and-down table 42 and is shaped like a rectangular column. The up-and-down table 42 is provided with a drive mechanism 44, such as a motor, which moves the up-and-down table 42 in the Z direction. The drive mechanism 44 is connected to the controller 45 via a signal line 71. That is, the drive mechanism 44 moves the up-and-down table 42 to a certain position in accordance with an instruction from the controller 45. The pallet 41 and the up-and-down table 42 together correspond to a stacking table.

Position detecting sensors 51 to 54 are provided on a pair of side walls 43*a* and 43*b* of the side wall part 43 that are perpendicular to the X direction. Each of the position detecting sensors 51 to 54 is configured as, for example, a light-transmission type sensor. The position detecting sensors 51 to 54 include light emitters 51*a* to 54*a* provided on the side wall 43*a* and light receivers 51*b* to 54*b* provided on the side wall 43*b* with each of the light emitters 51*a* to 54*a* and a corresponding one of the light receivers 51*b* to 54*b* facing each other. The light-transmission type sensors detect an object present between the light emitters 51*a* to 54*a* and the light receivers 51*b* to 54*b* based on whether light emitted from each of the light emitters 51*a* to 54*a* has reached a corresponding one of the light receivers 51*b* to 54*b*. The position detecting sensors 51 to 54 detect an approximate position of the pallet 41 inside the side wall part 43 or of the upper face of papers stacked on the pallet 41, based on whether objects are detected by the position detecting sensors 51 to 54 provided on the side walls 43*a* and 43*b* at different heights. In the illustrated example, those position detecting sensors 51 to 54 are individually provided at respective predetermined heights with one sensor at the same height and at around the center of the side walls 43*a* and 43*b* in the Y direction.

Highest-limit detecting sensors 61 and 62 and excessive-elevation detecting sensors 63 and 64 are provided on a pair of side walls 43*c* and 43*d* of the side wall part 43 that have faces perpendicular to the Y direction. Each of the excessive-elevation detecting sensors 63 and 64 is an example of a first detector. The upper-limit detecting sensors 61 and 62 and the excessive-elevation detecting sensors 63 and 64 are provided above the position detecting sensors 51 to 54. Each of the upper-limit detecting sensors 61 and 62 and the excessive-elevation detecting sensors 63 and 64 is also configured as a light-transmission type sensor. For example, light emitters 61*a* to 64*a* are provided on the side wall 43*c*, and light receivers 61*b* to 64*b* are provided on the side wall 43*d*.

The upper-limit detecting sensors 61 and 62 detect an upper limit position at which the pallet 41 or the upper face of papers 100 stacked on the pallet 41 is allowed to be positioned during a paper stacking process. That is, the upper-limit detecting sensors 61 and 62 are provided at positions corresponding to the upper limit position that the pallet 41 having none of the papers 100 stacked thereon or the upper face of papers 100 stacked on the pallet 41 can reach within the paper stacking apparatus 40. In this example, two sensors are provided as the upper-limit detecting sensors 61 and 62 and these two upper-limit detecting sensors 61 and 62 are provided at the same height as each other. This upper limit position is a position that is slightly higher than a reference position at which the papers 100 discharged from the image forming apparatus 10 are received.

The excessive-elevation detecting sensors 63 and 64 are provided further above the upper-limit detecting sensors 61 and 62 and are sensors that detect excessive elevation of the pallet 41. The excessive-elevation detecting sensors 63 and 64 are provided below the positions of conveyance clips described below of the image forming apparatus 10 that are provided above the paper stacking apparatus 40. In this example, two sensors are provided as the excessive-elevation detecting sensors 63 and 64 and these two excessive-elevation detecting sensors 63 and 64 are provided at the same height as each other. While this example illustrates a case in which two sensors are provided as the excessive-elevation detecting sensors 63 and 64, only one sensor may be provided or three or more sensors may be provided.

The position detecting sensors 51 to 54, the upper-limit detecting sensors 61 and 62, and the excessive-elevation detecting sensors 63 and 64 described above are connected to the controller 45 over the signal line 71. Information representing whether light from each of the light emitters 51*a* to 54*a* and 61*a* to 64*a* has been received by a corresponding one of the light receivers 51*b* to 54*b* and 61*b* to 64*b* is transmitted to the controller 45.

The controller 45 includes, for example, a central processing unit (CPU), a read only memory (ROM), and a random access memory (RAM). When a computer program stored in the ROM is loaded on the RAM and executed by the CPU, the controller 45 controls the paper stacking apparatus 40. In this example, the controller 45 elevates and lowers the position of the up-and-down table 42 by means of the drive mechanism 44. For example, when the papers 100 discharged from the image forming apparatus 10 are received, the controller 45 controls the drive mechanism 44 to lower the pallet 41 so that the upper face of the pallet 41 or the upper face of the papers 100 stacked on the pallet 41 cannot be detected by the upper-limit detecting sensors 61 and 62.

In the present embodiment, the controller 45 determines whether the pallet 41 has been excessively elevated by using a signal acquired from the excessive-elevation detecting sensors 63 and 64. Detection of the excessive elevation represents detection that the pallet 41 has passed by the excessive-elevation detecting sensors 63 and 64 upward from below. However, a direction in which an object moves cannot be specified by the detection by the excessive-elevation detecting sensors 63 and 64. That is, in the paper stacking apparatus 40, the paper 100 that falls downward from above also passes by the excessive-elevation detecting sensors 63 and 64, and falling of each of the papers 100 therefore results in a determination that excessive elevation has been detected.

Given this point, in order not to perform an erroneous determination that falling of the paper 100 is recognized as that the pallet 41 has been excessively elevated, the controller 45 compares, with an excessive-elevation determination value of time set to be larger than a passage time period during which the paper 100 passes by the excessive-elevation detecting sensors 63 and 64 when falling, a detection time period during which an object that passes by the excessive-elevation detecting sensors 63 and 64 has been detected. The detection time period represents, in other words, an elapsed time after the excessive-elevation detecting sensor 63 or 64 starts to the detection. When the detection time period is smaller than the excessive-elevation determination value, the controller 45 determines that the paper stacking apparatus 40 operates normally because the paper 100 that is falling has been detected. When the detection time period is larger than the excessive-elevation determination value, the controller 45 determines that the excessive elevation has occurred. Additionally, upon determining that the pallet 41 has been excessively elevated, the controller 45 prohibits, by means of software or hardware, the drive mechanism 44 from driving in an elevating direction. For example, when the drive mechanism 44 is an up-and-down motor, the controller 45 prohibits the up-and-down motor from rotating upward. The controller 45 prohibits the drive mechanism 44 only from driving in the elevating direction and does not prohibit the drive mechanism 44 from driving in any directions other than the elevating direction.

Figure 3:
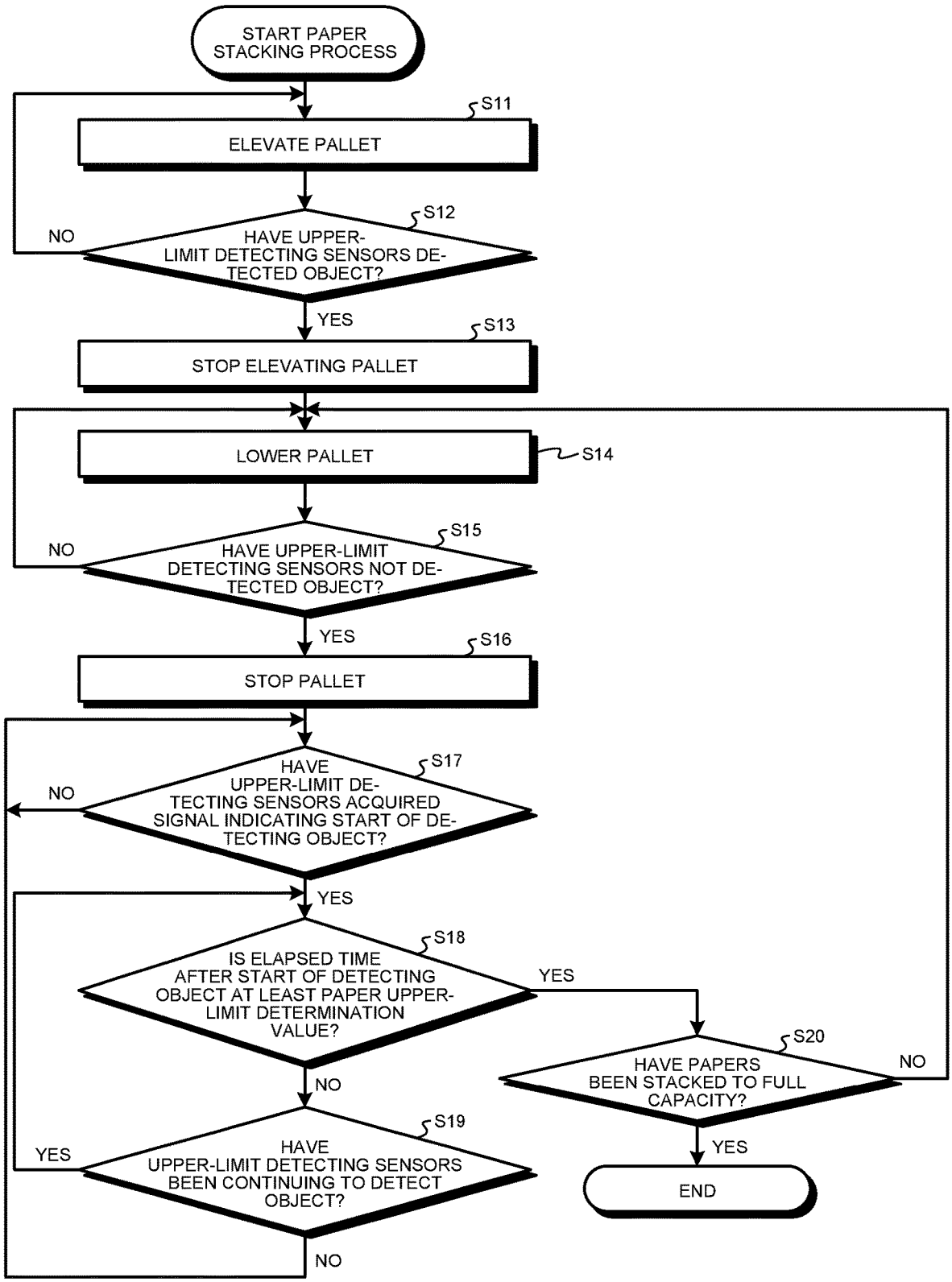
FIG. 3 is a flowchart illustrating an example of the procedure of a method of controlling a paper stacking apparatus according to the first embodiment.
Figure 4:
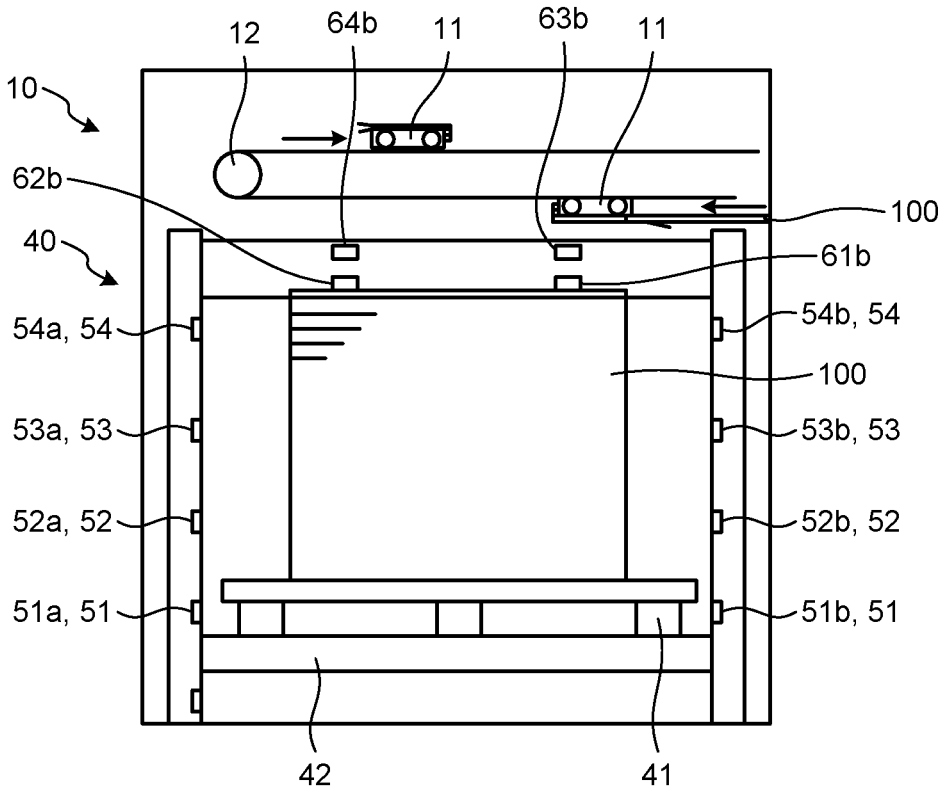
FIG. 4 is a sectional view schematically illustrating an example of the procedure of a paper stacking process that is performed in the paper stacking apparatus according to the first embodiment.

Next, a method of controlling the paper stacking apparatus 40 will be described. The following first describes the paper stacking process and then an excessive-elevation detecting process. FIG. 3 is a flowchart illustrating an example of the procedure of the control method according to the first embodiment. FIG. 4 is a sectional view schematically illustrating an example of the procedure of the paper stacking process that is performed in the paper stacking apparatus according to the first embodiment. FIG. 4 also illustrates some components of the image forming apparatus 10 above the paper stacking apparatus 40.

Firstly, the controller 45 instructs the drive mechanism 44 of the paper stacking apparatus 40 to elevate the up-and-down table 42. This instruction causes the drive mechanism 44 to elevate the pallet 41 (step S11). The pallet 41 may have no object or may have the papers 100 placed on the upper face thereof.

When the pallet 41 is being elevated, the controller 45 determines whether the upper-limit detecting sensors 61 and 62 have detected an object (step S12). For example, the controller 45 determines whether a signal has been received, which indicates the upper-limit detecting sensors 61 and 62 have detected an object. When no object has been detected (No at step S12), the process returns to step S11, and the controller 45 elevates the pallet 41 until the upper-limit detecting sensors 61 and 62 detect an object.

In contrast, when an object has been detected (Yes at step S12), the controller 45 instructs the drive mechanism 44 to stop elevating the pallet 41. The drive mechanism 44 stops elevating the pallet 41 (step S13). The detection of an object is carried out when the light receivers 61*b* and 62*b* of the upper-limit detecting sensors 61 and 62 are obstructed by the pallet 41 or the papers 100 stacked on the pallet 41.

After that, the controller 45 instructs the drive mechanism 44 to lower the pallet 41. The drive mechanism 44 lowers the pallet 41 (step S14). At this step, the pallet 41 is still present between the light emitters 61*a* and 62*a* and the light receivers 61*b* and 62*b* of the upper-limit detecting sensors 61 and 62, and the controller 45 is in a state of having an object being detected. When the pallet 41 is being lowered, the controller 45 determines whether the state in which an object is detected by the upper-limit detecting sensors 61 and 62 is ended (step S15). For example, the controller 45 determines whether a signal that indicates the upper-limit detecting sensors 61 and 62 have detected an object has become off. When the state in which an object is detected is not ended (No at step S15), the process returns to step S14. Thereafter, the pallet 41 is lowered until the state in which an object is detected is ended.

When the state in which an object is detected is ended (Yes at step S15), the controller 45 instructs the drive mechanism 44 to stop lowering the pallet 41. The drive mechanism 44 stops lowering the pallet 41 (step S16). This position is defined as a standby position. For example, as illustrated in FIG. 4, a standby state is entered when the topmost portion of the papers 100 stacked on the pallet 41 is at a position not covered by the upper-limit detecting sensors 61 and 62.

Thereafter, as illustrated in FIG. 4, the individual papers 100 on which printing has been performed by a paper-fed printing press are conveyed by conveyance clips to a position above the paper stacking apparatus 40. Each of the papers 100 is then dropped from the conveyance clip at the position above the paper stacking apparatus 40. The papers 100 dropped from the clip are placed on the pallet 41 with ends thereof being aligned by a paper jogger not illustrated.

When each of the papers 100 is dropped, the upper-limit detecting sensors 61 and 62 detect the presence of an object although the detection is for a brief moment. In some cases, when the paper 100 dropped is placed onto the pallet 41, the upper face of the papers 100 on the pallet 41 reaches a position covered by the upper-limit detecting sensors 61 and 62.

The controller 45 determines whether the upper-limit detecting sensors 61 and 62 have acquired signals each representing the start of detecting an object (step S17). When the signal representing the start of detecting the object has not been acquired (No at step S17), the process enters a waiting state until the signal representing the start of detecting an object is acquired. When the signal representing the start of detecting the object has been acquired (Yes at step S17), the controller 45 determines whether an elapsed time after starting to detect the object is at least a paper upper-limit determination value of time (step S18). The paper upper-limit determination value of time has been set to indicate a time period longer than a time period during which the paper 100 passes by the upper-limit detecting sensors 61 and 62. Alternatively, the paper upper-limit determination value is set to indicate a time period having a length such that, when the upper-limit detecting sensors 61 and 62 detect the paper 100 falling, an erroneous determination that the upper face of the papers 100 on the pallet 41 has reached a position covered by the upper-limit detecting sensors 61 and 62 can be avoided.

When the elapsed time after the start of detecting the object is smaller than the paper upper-limit determination value (No at step S18), the controller 45 determines whether the upper-limit detecting sensors 61 and 62 is continuing to detect the object (step S19). When the upper-limit detecting sensors 61 and 62 is continuing to detect the object (Yes at step S19), the process returns to step S18.

When the upper-limit detecting sensors 61 and 62 is not continuing to detect the object (No at step S19), this means that the signals detected by the upper-limit detecting sensors 61 and 62 are caused due to falling of the paper 100. That is, those signals do not represent that the papers 100 on the pallet 41 have reached the upper-limit position, and the process therefore returns to step S17.

When the elapsed time after the start of detecting the object is at least the paper upper-limit determination value at step S18 (Yes at step S18), the controller 45 determines, for example, based on the position of the pallet 41, whether the papers 100 on the pallet 41 have been stacked to the full capacity (step S20). When the papers 100 on pallet 41 have not been stacked to the full capacity (No at step S20), the process returns to step S14. When the papers 100 on pallet 41 have been stacked to the full capacity (Yes at step S20), the paper stacking processing ends.

Figure 5:
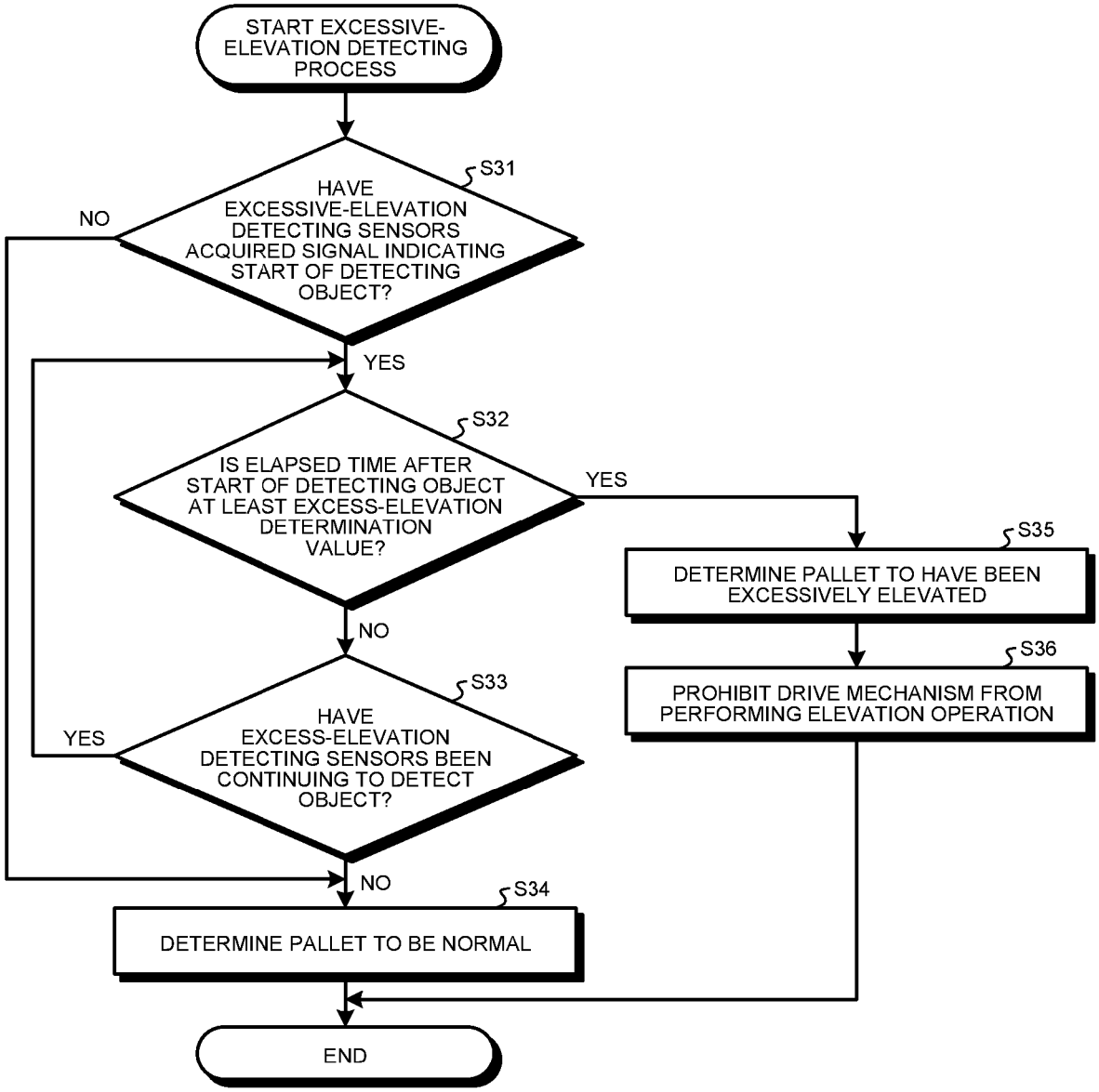
FIG. 5 is a flowchart illustrating an example of the procedure of an excessive-elevation detecting process according to the first embodiment.
Figure 6:
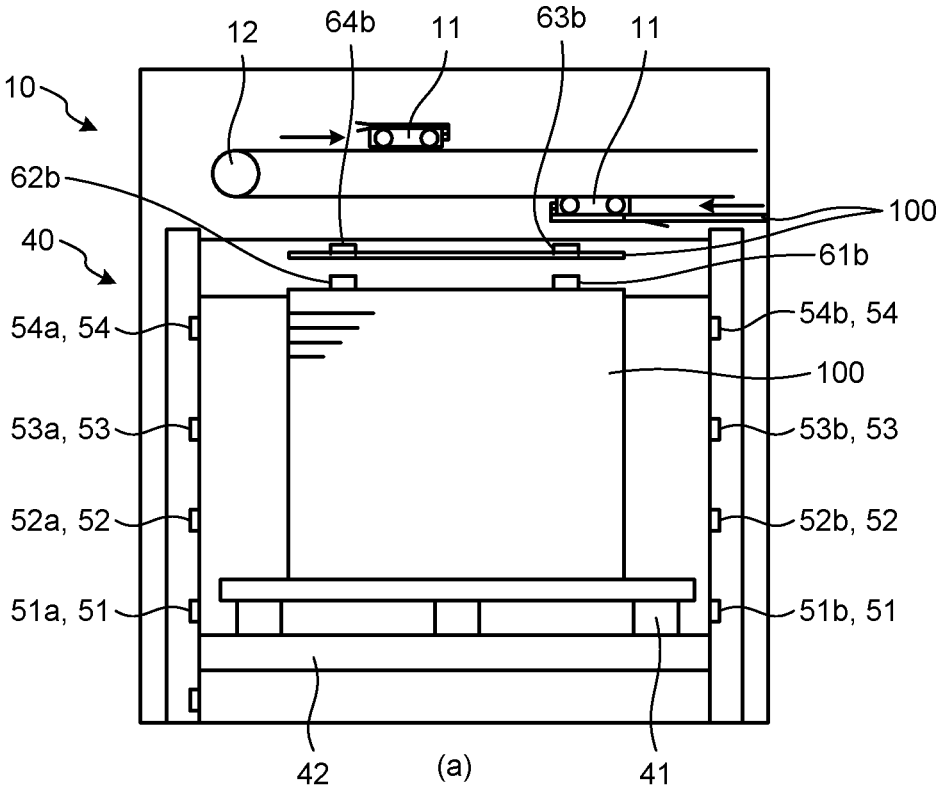
FIG. 6 illustrates sectional views schematically illustrating an example of the procedure of the excessive-elevation detecting process that is performed in the paper stacking apparatus according to the first embodiment.
Figure 6:
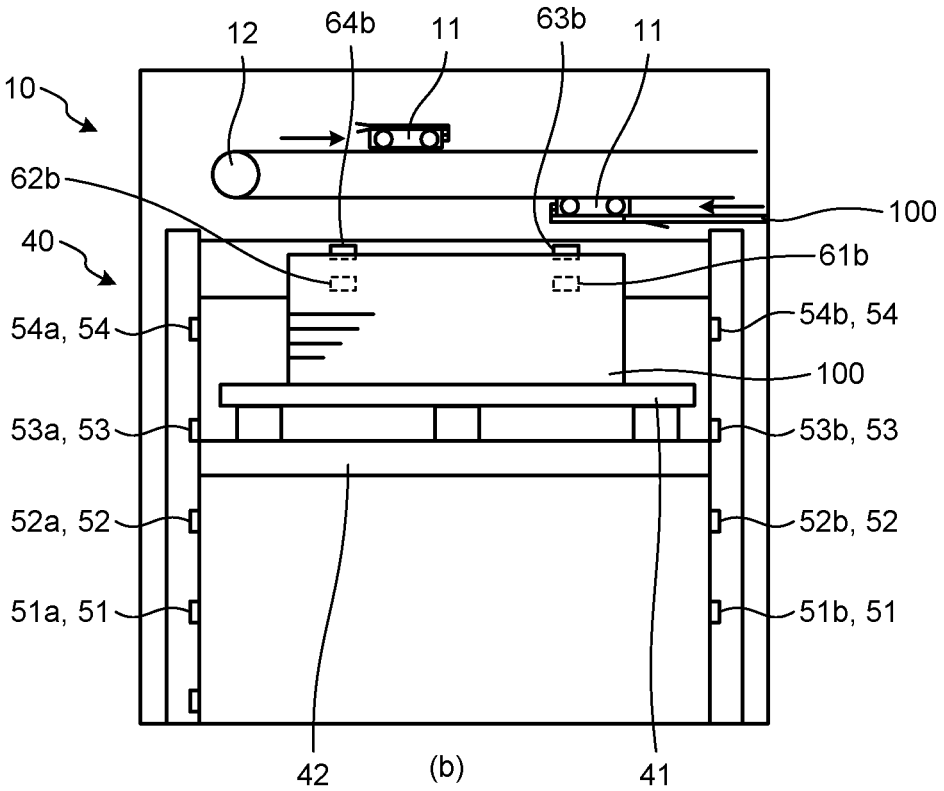

FIG. 5 is a flowchart illustrating an example of the procedure of an excessive-elevation detecting process according to the first embodiment. FIGS. 6(*a*) and 6(*b*) are sectional views schematically illustrating an example of the procedure of the excessive-elevation detecting process to be performed by the paper stacking apparatus according to the first embodiment. Each of FIGS. 6(*a*) and 6(*b*) also illustrates some components of the image forming apparatus 10 above the paper stacking apparatus 40.

Firstly, the controller 45 determines whether the excessive-elevation detecting sensors 63 and 64 have acquired a signal representing the start of detecting an object (step S31). That is, it is determined whether an object has passed by the excessive-elevation detecting sensors 63 and 64.

When the excessive-elevation detecting sensors 63 and 64 have acquired a signal representing the start of detecting an object (Yes at step S31), the controller 45 determines whether the elapsed time after the start of detecting the object is at least an excess-elevation determination value (step S32). When the elapsed time after the start of detecting the object is less than the excess-elevation determination value (No at step S32), the controller 45 determines whether the excessive-elevation detecting sensors 63 and 64 is continuing to detect the object (step S33).

When the excessive-elevation detecting sensors 63 and 64 is continuing to detect the object (Yes at step S33), the process returns to step S32. When the excessive-elevation detecting sensors 63 and 64 is not continuing to detect the object (No at step S33), it indicates that the object detected by the excessive-elevation detecting sensors 63 and 64 is the paper 100 that is falling from the conveyance clip 11 of the image forming apparatus 10, for example, as illustrated in (a) of FIG. 6. The controller 45 therefore determines that the pallet 41 is operating normally (step S34). As illustrated in (a) of FIG. 6, each of the conveyance clips 11 moves inside the image forming apparatus 10 while holding one of the papers 100 that is being conveyed thereby and drops that paper 100 at a position above the paper stacking apparatus 40. For example, the conveyance clips 11 are attached to a belt and moves inside the image forming apparatus 10 when a roller 12 rotates.

When the excessive-elevation detecting sensors 63 and 64 have not acquired a signal representing the start of detecting an object at step S31 (No at step S31), the controller 45 determines that the pallet 41 is operating normally (step S34). The process then ends.

When the elapsed time after the start of detecting the object is at least the excess-elevation determination value at step S32 (Yes at step S32), the controller 45 determines that the pallet 41 has been excessively elevated (step S35). For example, such a state corresponds to a case when the pallet 41 has been elevated to the extent that the upper face of the papers 100 obstructs the front of the light receivers 63*b* and 64*b* of the excessive-elevation detecting sensors 63 and 64 as illustrated in (b) of FIG. 6. The controller 45 prohibits the drive mechanism 44 from performing elevation operation (step S36). The controller 45 instructs, by means of software or hardware, the prohibition from performing elevation operation. At this step, operation to elevate the pallet 41 is prohibited, whereas operation to lower the pallet 41 is not prohibited. This control prevents the pallet 41 or the papers 100 on the pallet 41 from colliding with the conveyance clip 11 due to excessive elevation of the pallet 41. As a result, the conveyance clip 11 is prevented from being damaged. The processing then ends.

Figure 7:
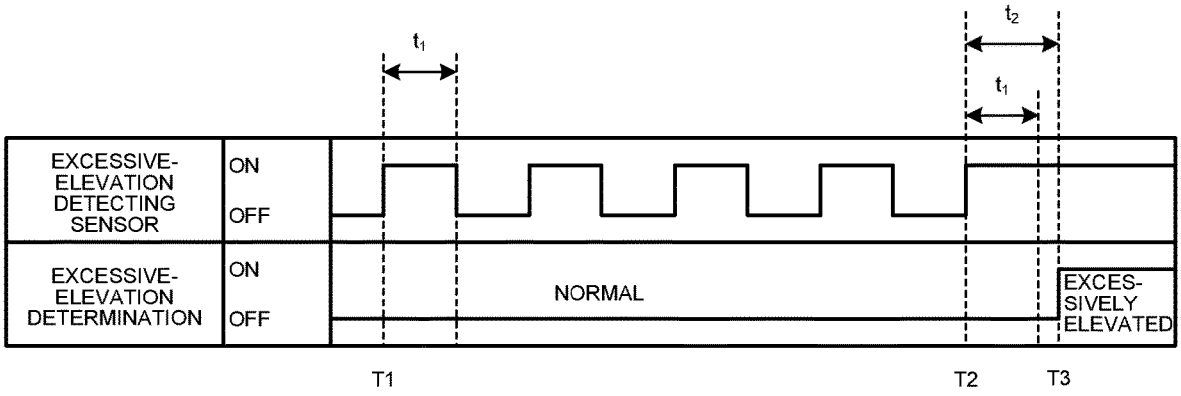
FIG. 7 illustrates an example of object detection signals from excessive-elevation detecting sensors according to the first embodiment.

FIG. 7 illustrates an example of object detection signals from the excessive-elevation detecting sensor according to the first embodiment. In FIG. 7, the upper row illustrates an example of an object detection signal detected by the excessive-elevation detecting sensors 63 and 64. The object detection signal, when being "ON", indicates that an object has been detected and, when being "OFF", indicates that an object has not been detected. The lower row illustrates an example of the result of the excessive-elevation determination by the controller 45. The result, when being "ON", indicates that excessive elevation has been detected and, when being "OFF", indicates that excessive elevation has not been detected.

When, as illustrated in (a) of FIG. 6 the individual papers 100 are discharged from the image forming apparatus 10 at certain periodic time intervals and are dropped on the paper stacking apparatus 40, the excessive-elevation detecting sensors 63 and 64 acquire an object detection signal that becomes "ON" upon detection of each of the papers 100, as illustrated in the upper row in FIG. 7. For example, a length of the object detection signal at a clock time T1 corresponds to a passage time period $t_1$ during which a corresponding one of the papers 100 passes by. In this case, the passage time period $t_1$ is smaller than the excessive-elevation determination value $t_2$. Such a state is therefore not determined to be excessive elevation, which means that the pallet 41 is operating normally.

In contrast, when the upper face of the papers 100 has already reached a position covered by the excessive-elevation detecting sensors 63 and 64 as a result of excessive elevation of the pallet 41 as illustrated in (b) of FIG. 6, the excessive-elevation detecting sensors 63 and 64 start detecting an object at a clock time T2 in FIG. 7. Thereafter, such a state is not determined to be excessive elevation until the excessive-elevation determination value $t_2$ passes after the start of detecting the object. As illustrated in the lower row in FIG. 7, however, when the time period that has passed is equal to the excessive-elevation determination value $t_2$, the excessive-elevation determination results in "ON" at clock time T3.

While the above description illustrates excessive elevation of the pallet 41, the meaning of excessive elevation includes excessive stacking. For example, when the upper-limit detecting sensors 61 and 62 have gone out of order for some reason, detection of the upper face of the papers 100 by the excessive-elevation detecting sensors 63 and 64 can serve to prevent excessive stacking that would collide with the conveyance clip.

In the first embodiment, the excessive-elevation detecting sensors 63 and 64 are disposed above the upper-limit detecting sensors 61 and 62 configured to detect the upper limit position of the papers 100 and below the conveyance clip 11 of the image forming apparatus 10. When an elapsed time after starting to detect an object by the excessive-elevation detecting sensors 63 and 64 is at least the excessive-elevation determination value $t_2$, the controller 45 determines the pallet 41 to have been excessively elevated and prohibits, by means of software or hardware, the drive mechanism 44 from performing elevation operation. This configuration produces the advantage that excessive elevation can be detected in such a manner that, with consideration given to patterns of how the excessive-elevation detecting sensors 63 and 64 detect excessive elevation, falling of the paper 100 from the image forming apparatus 10 is not erroneously determined to be excessive elevation. As a result, the conveyance clip 11 of the image forming apparatus 10 is prevented from being damaged. This configuration also produces the advantage that a time period that it takes to recover from the occurrence of excessive elevation can be reduced because the drive mechanism 44 is prohibited from performing elevation operation and is allowed only to rotate in a direction for lowering operation.

Furthermore, two or more sensors serving as the excessive-elevation detecting sensors 63 and 64 are provided at the same height, whereby, even when one of the excessive-elevation detecting sensors has gone out of order, the other excessive-elevation detecting sensor or sensors can carry out detection.

Second Embodiment

Figure 8:
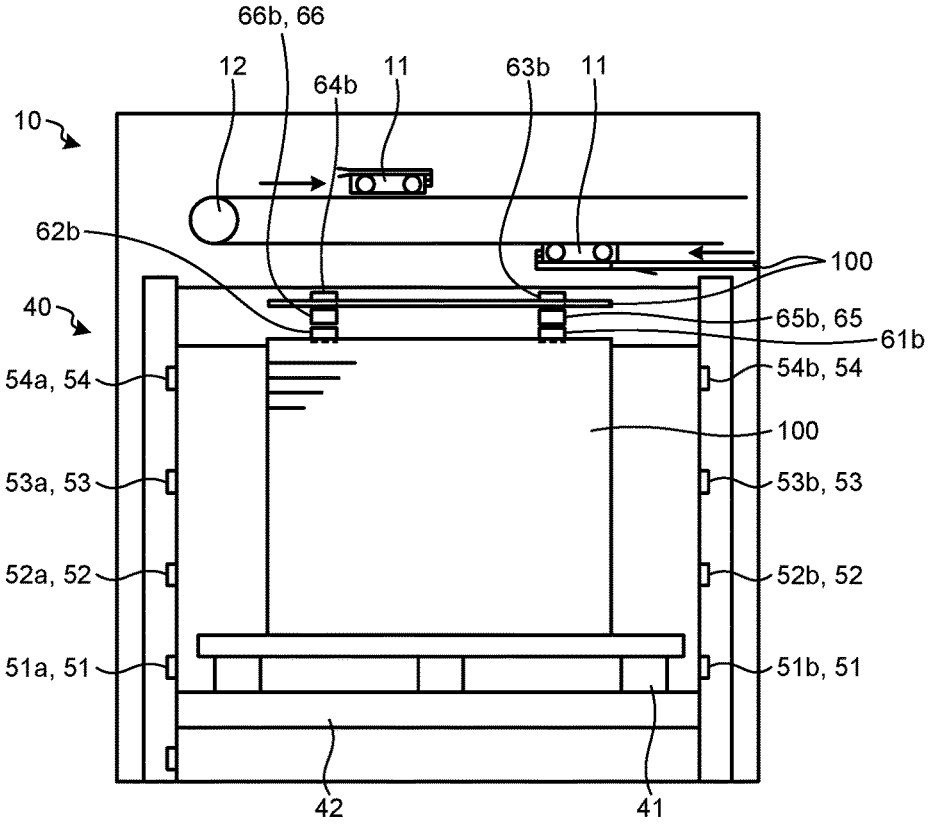
FIG. 8 schematically illustrates an example of the configuration of a paper stacking apparatus according to a second embodiment.

FIG. 8 schematically illustrates an example of the configuration of a paper stacking apparatus according to a second embodiment. FIG. 8 also illustrates some components of the image forming apparatus 10 above the paper stacking apparatus 40. The following describes only parts different from the first embodiment.

The paper stacking apparatus 40 according to the second embodiment further includes preliminary excessive-elevation detecting sensors 65 and 66 between the excessive-elevation detecting sensors 63 and 64 and the upper-limit detecting sensors 61 and 62. Each of the excessive-elevation detecting sensors 65 and 66 is an example of a second detector. Each of the preliminary excessive-elevation detecting sensors 65 and 66 is configured as, for example, a light-transmission type sensor. For example, light emitters not illustrated are provided on the side wall 43*c*, and light receivers 65*b* and 66*b* are provided on the side wall 43*d*.

The preliminary excessive-elevation detecting sensors 65 and 66 are sensors that detect excessive elevation of the pallet 41 in combination with the excessive-elevation detecting sensors 63 and 64. In this example, two sensors are disposed as the preliminary excessive-elevation detecting sensors 65 and 66 and these two preliminary excessive-elevation detecting sensors 65 and 66 are provided at the same height as each other. The preliminary excessive-elevation detecting sensors 65 and 66 are connected to the controller 45 via the signal line 71. For example, information on whether light from the light emitters has been received by the light receivers 65*b* to 66*b* is transmitted to the controller 45. While this example illustrates a case in which two sensors are disposed as the preliminary excessive-elevation detecting sensors 65 and 66, only one sensor may be disposed or three or more sensors may be disposed.

When a state, in which the excessive-elevation detecting sensors 63 and 64 are detecting an object at the same time as the preliminary excessive-elevation detecting sensors 65 and 66 are detecting an object, has continued for a time period that is at least an excessive-elevation determination value $t_4$, the controller 45 determines that excessive elevation has occurred. Otherwise, the controller 45 determines that the operation is normal. As in the case with the first embodiment, the excessive-elevation determination value $t_4$ is set to a length such that falling of the paper 100 from the image forming apparatus 10 cannot be erroneously determined to be excessive elevation.

Figure 9:
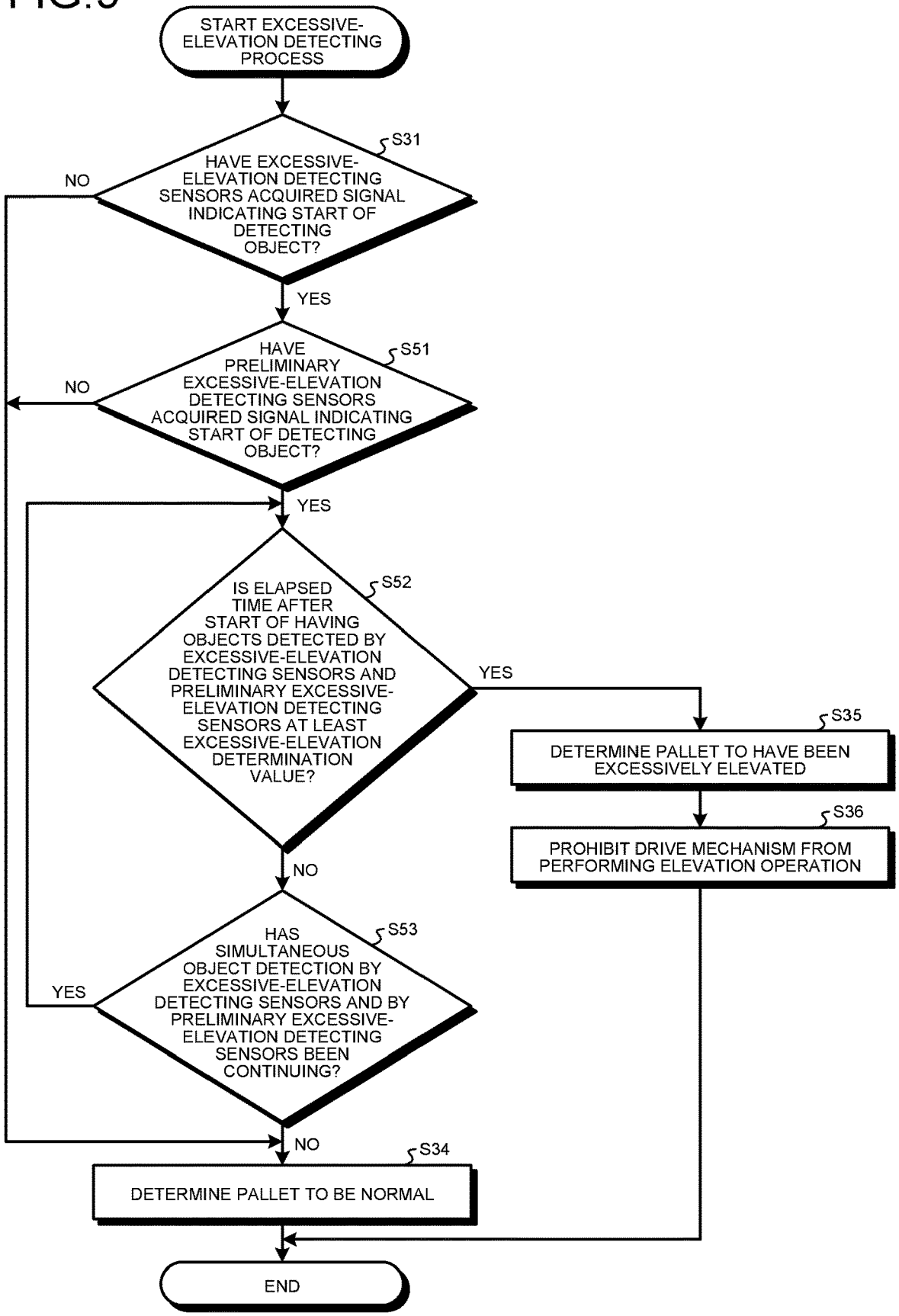
FIG. 9 is a flowchart illustrating an example of the procedure of an excessive-elevation detecting process according to the second embodiment.

Next, excessive-elevation detecting according to the second embodiment will be described. FIG. 9 is a flowchart illustrating an example of the procedure of excessive-elevation detecting according to the second embodiment. The following describes only parts different from FIG. 5 for the first embodiment.

When, at step S31, the excessive-elevation detecting sensors 63 and 64 have acquired a signal representing the start of detecting an object (Yes at step S31), the controller 45 determines whether the preliminary excessive-elevation detecting sensors 65 and 66 have acquired a signal representing the start of detecting an object (step S51).

When the preliminary excessive-elevation detecting sensors 65 and 66 have acquired a signal representing the start of detecting an object (Yes at step S51), it means that objects have been detected by the excessive-elevation detecting sensors 63 and 64 and by the preliminary excessive-elevation detecting sensors 65 and 66. At this step, the controller 45 determines whether an elapsed time after the start of having objects detected simultaneously by the excessive-elevation detecting sensors 63 and 64 and by the preliminary excessive-elevation detecting sensors 65 and 66 is at least the excessive-elevation determination value (step S52).

When the elapsed time after the start of having objects detected thus simultaneously is smaller than the excessive-elevation determination value (No at step S52), the controller 45 determines whether the simultaneous object detection by the excessive-elevation detecting sensors 63 and 64 and by the preliminary excessive-elevation detecting sensors 65 and 66 is continuing (step S53). When the simultaneous object detection by the excessive-elevation detecting sensors 63 and 64 and by the preliminary excessive-elevation detecting sensors 65 and 66 is continuing (Yes at step S53), the process returns to step S52.

When the simultaneous object detection by the excessive-elevation detecting sensors 63 and 64 and by the preliminary excessive-elevation detecting sensors 65 and 66 is not continuing (No at step S53), that is, the object detection by the excessive-elevation detecting sensors 63 and 64 or by the preliminary excessive-elevation detecting sensors 65 and 66 has been ended, the controller 45 determines that the pallet 41 is operating normally (step S34), and the processing ends.

The process proceeds to step S34 also when the preliminary excessive-elevation detecting sensors 65 and 66 have not acquired a signal representing the start of detecting an object at step S51 (No at step S51).

Furthermore, when the elapsed time after the start of simultaneously having objects detected by the excessive-elevation detecting sensors 63 and 64 and by the preliminary excessive-elevation detecting sensors 65 and 66 at step S52 is at least the excessive-elevation determination value (Yes at step S52), the process proceeds to step S35. That is, the pallet 41 is determined to have been excessively elevated and prohibits the drive mechanism 44 to performing elevation operation.

Figure 10:
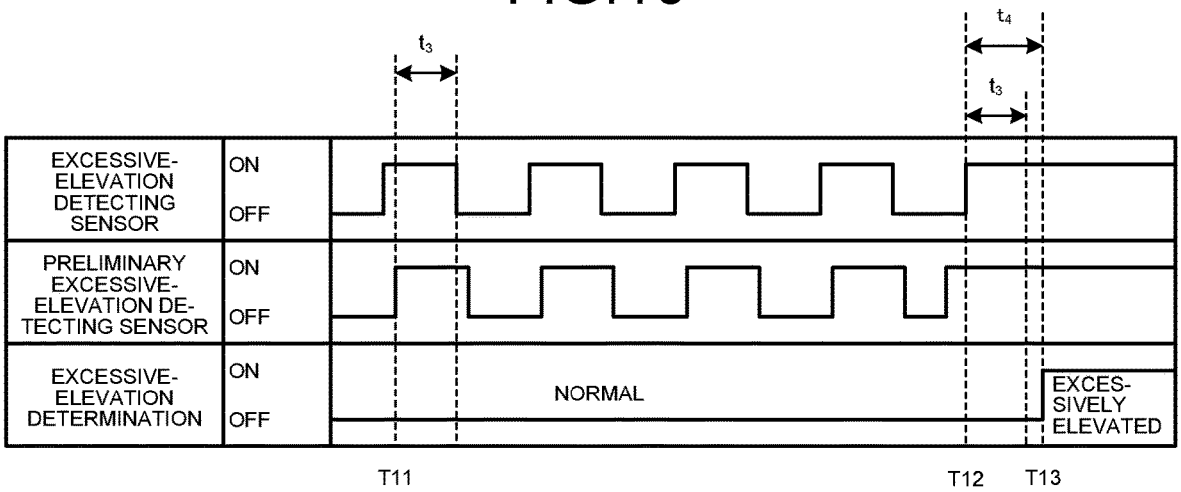
FIG. 10 illustrates an example of determination according to the second embodiment as to whether excessive elevation has been detected.

FIG. 10 illustrates an example of determination about excessive elevation detection according to the second embodiment. In FIG. 10, the upper row illustrates an example of an object detection signal detected by the excessive-elevation detecting sensors 63 and 64, and the middle row illustrates an example of an object detection signal detected by the preliminary excessive-elevation detecting sensors 65 and 66. In these drawings, "ON" represents that an object has been detected, and "OFF" represents that an object has not been detected. The lower row illustrates an example of the result of the excessive-elevation determination by the controller 45. "ON" represents that excessive elevation has been detected, and "OFF" represents that excessive elevation has not been detected.

When the individual papers 100 are discharged from the image forming apparatus 10 at certain periodic time intervals and are dropped on the paper stacking apparatus 40, the preliminary excessive-elevation detecting sensors 65 and 66 result in "ON" a short while after the excessive-elevation detecting sensors 63 and 64 result in "ON" as illustrated in the upper row and in the middle row in FIG. 10. That is, at a clock time T11, the excessive-elevation detecting sensors 63 and 64 and the preliminary excessive-elevation detecting sensors 65 and 66 simultaneously result in "ON". A time period $t_3$ from the clock time T11 to the time when the excessive-elevation detecting sensors 63 and 64 result in "OFF" is smaller than the excessive-elevation determination value $t_4$. Therefore, excessive elevation is determined not to have occurred, which means that the pallet 41 is operating normally.

In contrast, when the pallet 41 has been excessively elevated to a level such that the upper face of the papers 100 has reached a position covered by the excessive-elevation detecting sensors 63 and 64, the excessive-elevation detecting sensors 63 and 64 result in "ON" a short while after the preliminary excessive-elevation detecting sensors 65 and 66 result in "ON". That is, at a clock time T12, the excessive-elevation detecting sensors 63 and 64 and the preliminary excessive-elevation detecting sensors 65 and 66 simultaneously result in "ON". At a clock time T13 that is the time period $t_3$ after the clock time T12, over which the excessive-elevation detecting sensors 63 and 64 and the preliminary excessive-elevation detecting sensors 65 and 66 is continuing to be "ON", is at least the excessive-elevation determination value $t_4$, the excessive-elevation determination results in "ON".

In this example, each of the preliminary excessive-elevation detecting sensors 65 and 66 are provided between a corresponding one of the upper-limit detecting sensors 61 and 62 and a corresponding one of the excessive-elevation detecting sensors 63 and 64. Alternatively, two or more such sensors may be provided between the upper-limit detecting sensor and the excessive-elevation detecting sensor.

According to the second embodiment, the preliminary excessive-elevation detecting sensors 65 and 66 are provided at positions between the upper-limit detecting sensors 61 and 62 and the excessive-elevation detecting sensors 63 and 64. Furthermore, when a time period, from the start of simultaneous object detection by the excessive-elevation detecting sensors 63 and 64 and by the preliminary excessive-elevation detecting sensors 65 and 66, over which the simultaneous object detection is continuing is at least the excessive-elevation determination value, the controller 45 determines that the pallet 41 has been excessively elevated. This configuration also produces the same advantages as the configuration according to first embodiment.

Third Embodiment

In the foregoing first embodiment, the excessive-elevation detecting process may be configured: not to be executed while papers are being conveyed, which is when the paper stacking apparatus 40 is performing only lowering operation of the pallet 41; and to be executed only while papers are not being conveyed, which is when the paper stacking apparatus 40 is performing elevation operation of the pallet 41.

In the above configuration, the controller 45 masks an object detection signal received from the excessive-elevation detecting sensors 63 and 64 while papers are being conveyed. Only while papers are not being conveyed, the controller 45 executes the excessive-elevation detecting process described in the first embodiment. Paper conveyance in the paper stacking apparatus 40 is a process of moving the pallet 41 downward, which means that determination as to whether papers are being conveyed can be made based on, for example, whether the drive mechanism 44 is being commanded to perform elevation operation.

Figure 11:
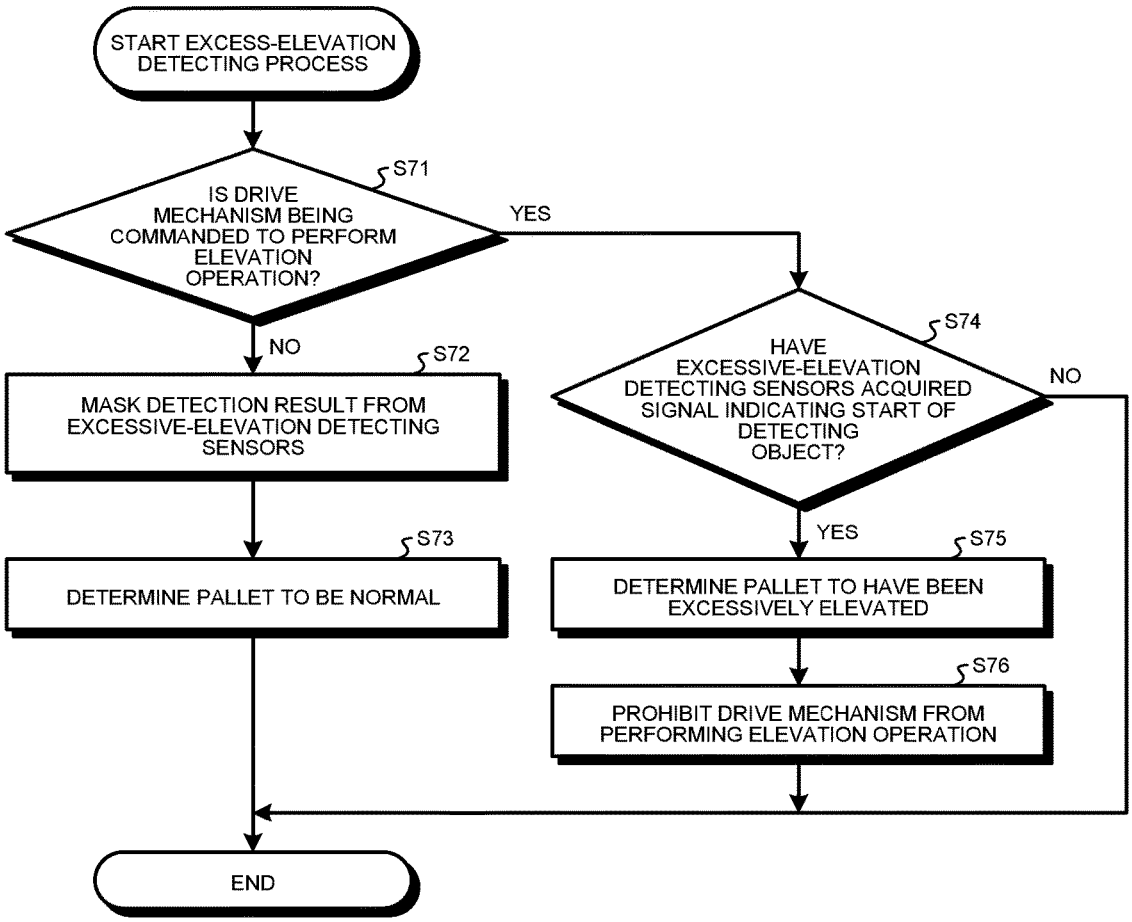
FIG. 11 is a flowchart illustrating an example of the procedure of an excessive-elevation detecting process according to the third embodiment.

FIG. 11 is a flowchart illustrating an example of the procedure of excessive-elevation detecting process according to the third embodiment. The controller 45 determines whether the drive mechanism 44 is being commanded to perform elevation operation (step S71). When the drive mechanism 44 is not being commanded to perform elevation operation (No at step S71), the drive mechanism 44 is being commanded to perform stopping operation or being commanded to perform lowering operation, and there is therefore no possibility that the pallet is being elevated. The controller 45 therefore masks the detection result of the excessive-elevation detecting sensors 63 and 64 (step S72) and determines that the pallet 41 is normal (step S73), and the processing ends.

When the drive mechanism is being commanded to perform elevation operation (Yes at step S71), the controller 45 determines whether the excessive-elevation detecting sensors 63 and 64 have acquired a signal representing the start of detecting an object (step S74). When a signal representing the start of detecting an object has been acquired (Yes at step S74), the controller 45 determines that the pallet 41 has been excessively elevated, regardless of the length of an elapsed time of detecting an object (step S75). The controller 45 then instructs the drive mechanism 44 to prohibit the drive mechanism 44 from performing elevation operation (step S76). The controller 45 instructs, by means of software or hardware, the drive mechanism 44 to prohibit the drive mechanism 44 from performing elevation operation. This control prevents the pallet 41 or the papers 100 on the pallet 41 from colliding with the conveyance clip 11 due to excessive elevation of the pallet 41. As a result, the conveyance clip 11 is prevented from being damaged. The processing then ends.

The processing also ends when the signal representing that the start of detecting an object has not been acquired at step S74 (No at step S74).

Figure 12:
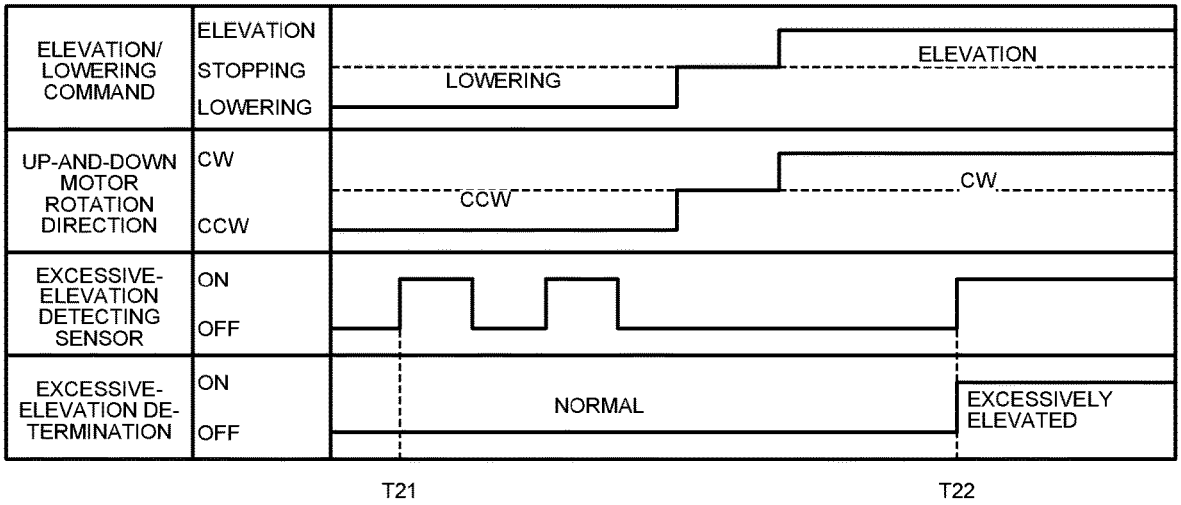
FIG. 12 illustrates an example of determination according to the third embodiment as to whether excessive elevation has been detected.

FIG. 12 illustrates an example of determination about excessive elevation detection according to the third embodiment. This drawing illustrates a signal for an elevation/lowering command, a signal representing the rotation direction of an up-and-down motor, an object detection signal from the excessive-elevation detecting sensors 63 and 64, and an excessive-elevation determination signal in order from the upper to lower rows.

As illustrated in FIG. 12, when an elevation/lowering command indicates lowering operation, the rotation direction of an up-and-down motor used as the drive mechanism 44 is counterclockwise (CCW). A signal from the excessive-elevation detecting sensors 63 and 64 is masked. In this situation, the controller 45 determines that the pallet 41 is normal even when the excessive-elevation detecting sensors 63 and 64 detect an object and acquire the signal that is "ON" at a clock time T21. The same applies when the elevation/lowering command indicates stopping operation.

In contrast, when the elevation/lowering command indicates elevation operation, the rotation direction of the up-and-down motor is clockwise (CW). In this situation, when the excessive-elevation detecting sensors 63 and 64 detect an object and acquire the "ON" signal at a clock time T22, the controller 45 determines that the pallet 41 has been excessively elevated, regardless of an elapsed time of the "ON" state. In the foregoing first and the second embodiments, excessive elevation is not determined to have occurred until after an elapsed time of the "ON" state becomes at least the excessive-elevation determination value. Thus, in the third embodiment, it takes less time to determine that excessive elevation has occurred than in the first and the second embodiments.

The third embodiment is able to produce the same advantages as the first embodiment.

Figure 13:
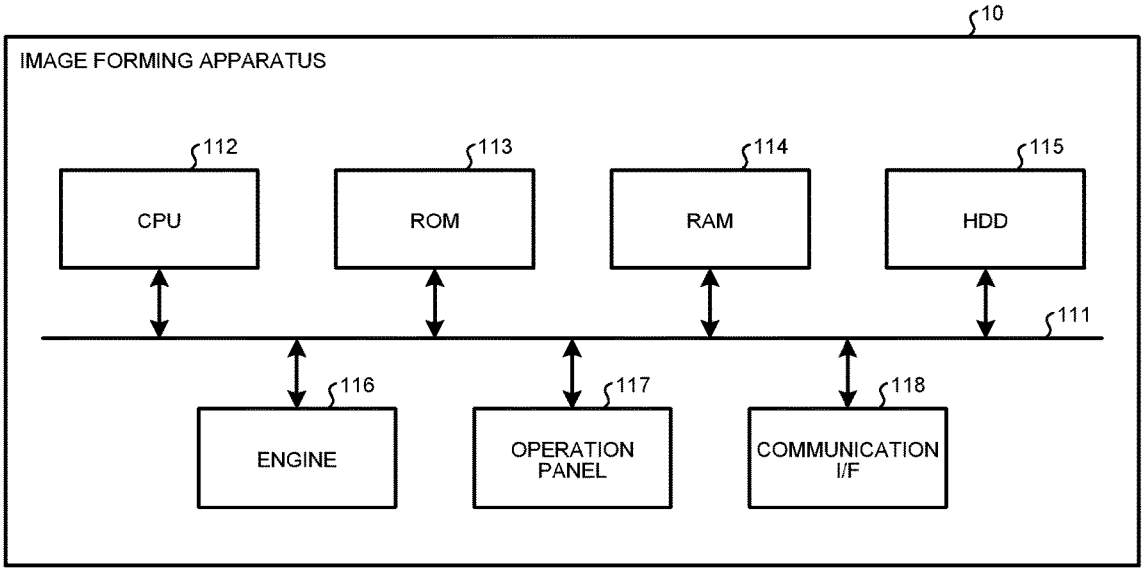
FIG. 13 is a block diagram illustrating an example of the hardware configuration of the image forming apparatus.

FIG. 13 is a block diagram illustrating an example of the hardware configuration of the image forming apparatus. The image forming apparatus 10 includes a CPU 112, a ROM 113, a RAM 114, and a hard disk drive (HDD) 115. In place of the HDD, another storage device such as a solid state drive (SSD) may be included. The image forming apparatus 10 further includes an engine 116, an operation panel 117, and a communication interface (I/F) 118. The above described individual components are connected to each other via a system bus 111.

The engine 116 executes various functions such as a copy function, a scanner function, and a printer function and is hardware that performs processing other than general information processing and communication for implementing these functions. For example, the engine 116 includes a scanner that reads an original document, a plotter that performs printing on paper materials such as papers, and the like. The engine 116 may further include specific options such as a finisher that sorts paper materials on which printing has been performed and an auto-document feeder (ADF) that automatically feeds papers of an original document.

The CPU 112 centrally controls operation of the image forming apparatus 10. The CPU 112 executes a computer program stored in the ROM 113, the HDD 115, or the like using the RAM 114 as a work area. The CPU 112 thereby controls operation of the entire image forming apparatus 10. That is, the CPU 112 causes the engine 116 to execute the above-described functions such as the scanner function and the printer function.

The operation panel 117 receives various kinds of input that correspond to user operations and displays various images (screens). Each of the present embodiments is described as a case in which the operation panel 117 is a touch panel that is integrally equipped with a receiving function for receiving various kinds of input and a display function for displaying various images (screens), but is not limited to such a case. For example, the operation panel 117 may be configured as a device separate from an input device that receives various kinds of input and a display device that displays various kinds of information.

The communication I/F 118 is an interface for communicating with an external device (for example, a client terminal) via a network.

A computer program to be executed on the image forming apparatus 10 according to each of the present embodiments is recorded as a file having an installable format or an executable format in a computer-readable recording medium such as a compact disc-read only memory (CD-ROM), a flexible disk (FD), a compact disc-recordable (CD-R), or a digital versatile disc (DVD) to be provided.

A computer-readable program to be executed on the image forming apparatus 10 according to each of the present embodiments may be configured to be stored on a computer connected to a network such as the Internet to be provided by being downloaded over the network. A computer-readable program to be executed on the image forming apparatus 10 according to each of the present embodiments may be configured to be provided or distributed over a network such as the Internet.

Furthermore, a computer-readable program to be executed on the image forming apparatus 10 according to each of the present embodiments may be configured to be previously stored in a program ROM or the like to be provided.

The present invention produces the advantage that erroneous determination that excessive stacking has occurred can be prevented when a paper that falls down from an upper position is detected.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A paper stacking apparatus comprising:

a stacking table including an upper face on which objects are stacked, each of the objects being dropped by a conveyance tool, the stacking table being capable of being elevated and lowered by a drive mechanism;

a first sensor disposed at a first position located below a position of the conveyance tool and configured to detect one of the objects falling from the conveyance tool, the upper face of the stacking table or an upper face of the stacked objects stacked on the stacking table; and a hardware processor coupled to the drive mechanism and the first sensor, the hardware processor being configured to determine that the stacking table is excessively elevated when an elapsed time after starting to detect one of the objects by the first sensor is at least a first excessive-elevation determination value of time, wherein the first excessive-elevation determination value of time represents a time period longer than a time period during which the one of the objects falling from the conveyance tool passes by the first sensor.

2. The paper stacking apparatus according to claim 1, wherein, when the excessive elevation is detected, the hardware processor is configured to stop the drive mechanism from driving in a direction of the elevation and allows the drive mechanism to drive in a direction of the lowering.

3. The paper stacking apparatus according to claim 1, further comprising a second sensor disposed at a second position between the first position and an upper limit position that the upper face of the stacking table or the upper face of the stacked objects is allowed to reach within the paper stacking apparatus, the second sensor being configured to detect the upper face of the stacking table or the upper face of the stacked objects, wherein the hardware processor is further configured to determine that the stacking table is excessively elevated when an elapsed time after starting to detect one of the objects by both of the first sensor and the second sensor is at least a second excessive-elevation determination value of time.

4. The paper stacking apparatus according to claim 1, wherein the hardware processor carries out the determination on the excessive elevation based on detection of the one of the objects by the first sensor while causing the drive mechanism to elevate the stacking table, and masks detection of the one of the objects by the first sensor while not causing the drive mechanism to elevate the stacking table.

5. The paper stacking apparatus according to claim 1, wherein the first sensor includes a first light emitter and a first light receiver that are disposed to face each other across the stacking table, and the hardware processor is configured to detect the one of the objects based on presence or absence of light that is received by the first light receiver after emitted from the first light emitter.

6. The paper stacking apparatus according to claim 3, wherein the second sensor includes a second light emitter and a second light receiver that are disposed to face each other across the stacking table, and the hardware processor is configured to detect the one of the objects based on presence or absence of light that is received by the second light receiver after emitted from the second light emitter.

7. The paper stacking apparatus according to claim 1, wherein the hardware processor is configured to compare the elapsed time after starting to detect one of the objects by the first sensor with the first excessive-elevation determination value of time set to be longer than the time period during which the one of the objects passes by the first sensor when falling.

8. A control method implemented by a computer as a paper stacking apparatus, the control method comprising:

acquiring a signal from a first sensor disposed at a first position located below a position of a conveyance tool and detecting one of objects falling from the conveyance tool, an upper face of a stacking table or an upper face of stacked objects placed on the stacking table, the signal representing that the first sensor starts to detect one of the objects;

determining whether an elapsed time after starting to detect the one of the objects by the first sensor is at least a first excessive-elevation determination value of time; and determining that the stacking table is excessively elevated when the elapsed time is at least the first excessive-elevation determination value of time, wherein the first excessive-elevation determination value of time represents a time period longer than a time period during which the one of the objects falling from the conveyance tool passes by the first sensor.

9. The control method of claim 8, further comprising:

stopping a drive mechanism from driving the stacking table in a direction of the elevation and allowing the drive mechanism to drive the stacking table in a direction of the lowering when the excessive elevation is determined.

10. The control method of claim 8, further comprising acquiring a second signal from a second sensor disposed at a second position between the first position and an upper limit position that the upper face of the stacking table or the upper face of the stacked objects is allowed to reach within the paper stacking apparatus, the second signal representing that the second sensor starts to detect the one of the objects;

determining whether an elapsed time after starting to detect the one of the objects by the second sensor is at least a second excessive-elevation determination value of time; and determining that the stacking table is excessively elevated when an elapsed time after starting to detect the one of the objects by both of the first sensor and the second sensor is at least the second excessive-elevation determination value of time.

11. The control method of claim 8, wherein the first sensor includes a first light emitter and a first light receiver that are disposed to face each other across the stacking table, and detecting the one of the objects by the first sensor is based on presence or absence of light that is received by the first light receiver after emitted from the first light emitter.

12. The control method of claim 10, wherein the second sensor includes a second light emitter and a second light receiver that are disposed to face each other across the stacking table, and detecting the one of the objects by the second sensor is based on presence or absence of light that is received by the second light receiver after emitted from the second light emitter.

13. The control method of claim 8, wherein the determining that the stacking table is excessively elevated when the elapsed time is at least the first excessive-elevation determination value of time comprises:

comparing the elapsed time after starting to detect one of the objects by the first sensor with the first excessive-elevation determination value of time set to be longer than the time period during which the one of the objects passes by the first sensor when falling.

14. A non-transitory computer-readable recording medium on which an executable program is recorded, the executable program instructing a computer to:

acquire a signal from a first sensor disposed at a first position located below a position of a conveyance tool and detecting one of objects falling from the conveyance tool, an upper face of a stacking table or an upper face of stacked objects placed on the stacking table, the signal representing that the first sensor starts to detect one of the objects;

determine whether an elapsed time after starting to detect the one of the objects by the first sensor is at least a first excessive-elevation determination value of time; and determine that the stacking table is excessively elevated when the elapsed time is at least the first excessive-elevation determination value of time, wherein the first excessive-elevation determination value of time represents a time period longer than a time period during which the one of the objects falling from the conveyance tool passes by the first sensor.

* * * * *